US009174117B2

(12) United States Patent
MacDonald

(10) Patent No.: US 9,174,117 B2
(45) Date of Patent: Nov. 3, 2015

(54) ROULETTE WHEEL WITH SMART COVER

(71) Applicant: Marina Bay Sands Pte. Ltd., Singapore (SG)

(72) Inventor: Andrew MacDonald, Singapore (SG)

(73) Assignee: Las Vegas Sands Corp., Las Vegas, NV (US)

( * ) Notice: Subject to any disclaimer, the term of this patent is extended or adjusted under 35 U.S.C. 154(b) by 0 days.

(21) Appl. No.: 14/022,188

(22) Filed: Sep. 9, 2013

(65) Prior Publication Data

US 2014/0203504 A1 Jul. 24, 2014

Related U.S. Application Data

(60) Provisional application No. 61/754,454, filed on Jan. 18, 2013.

(51) Int. Cl.

| | |
|---|---|
| ***A63B 71/00*** | (2006.01) |
| ***A63F 5/00*** | (2006.01) |
| *A63F 7/36* | (2006.01) |
| *A63F 9/06* | (2006.01) |

(52) U.S. Cl.

CPC ..... *A63F 5/00* (2013.01); *A63F 2007/3677* (2013.01); *A63F 2009/064* (2013.01)

(58) Field of Classification Search

CPC ..... A63B 71/00
USPC ..... 273/142 E; 463/16, 20, 25
See application file for complete search history.

(56) References Cited

U.S. PATENT DOCUMENTS

| | | | | |
|---|---|---|---|---|
| 4,601,470 | A | 7/1986 | Kadota et al. | |
| 4,643,425 | A * | 2/1987 | Herzenberger | 463/17 |
| 6,520,854 | B1 | 2/2003 | McNally | |
| 6,588,435 | B1 * | 7/2003 | Gindi | 132/293 |
| 7,306,520 | B2 * | 12/2007 | Kaminkow et al. | 463/20 |
| 7,309,065 | B2 * | 12/2007 | Yoseloff et al. | 273/292 |
| 7,510,475 | B2 * | 3/2009 | Loose et al. | 463/31 |
| 7,601,063 | B2 * | 10/2009 | Okada | 463/20 |
| 7,798,897 | B2 * | 9/2010 | Okada | 463/20 |
| 7,841,597 | B2 * | 11/2010 | Cammegh | 273/142 R |
| 7,892,086 | B2 * | 2/2011 | Okada | 463/20 |
| 8,075,380 | B2 * | 12/2011 | Yokota et al. | 463/13 |
| 8,079,593 | B2 * | 12/2011 | Nicely et al. | 273/145 CA |
| 8,128,484 | B2 * | 3/2012 | Okada | 463/20 |
| 8,147,316 | B2 * | 4/2012 | Arezina et al. | 463/20 |

(Continued)

FOREIGN PATENT DOCUMENTS

EP 1736215 A1 12/2006

*Primary Examiner* — Michael Dennis
*Assistant Examiner* — Dolores Collins
(74) *Attorney, Agent, or Firm* — McDermott Will & Emery LLP

(57) ABSTRACT

A system and method is provided for delaying an outcome of a roulette game is disclosed. Accordingly, the system includes a roulette wheel and a glass cover attached to the roulette wheel, the glass cover configured to switch between a transparent state and an opaque state in response to electrical signals. Game circuitry is configured to operate a ball release mechanism to launch a ball around an inner circumference of the roulette wheel, and to send electrical signals to the glass cover while the ball is in to change the glass cover from the transparent state to the opaque state so that the ball cannot be viewed from outside the glass cover. After the ball has stopped, signals are sent to change the glass cover from the opaque state to the transparent state, so that the ball and the outcome of the game can be viewed.

17 Claims, 5 Drawing Sheets

(56) References Cited

U.S. PATENT DOCUMENTS

| | | | | |
|---|---|---|---|---|
| 8,152,170 | B2 * | 4/2012 | Yokota et al. | 273/138.1 |
| 8,210,922 | B2 * | 7/2012 | Williams et al. | 463/20 |
| 8,449,372 | B2 * | 5/2013 | Glenn et al. | 463/17 |
| 8,523,684 | B2 * | 9/2013 | Lutnick et al. | 463/47 |
| 8,734,245 | B2 * | 5/2014 | Kelly et al. | 463/30 |
| 2010/0120488 | A1 * | 5/2010 | Savytskyy | 463/17 |
| 2011/0018194 | A1 | 1/2011 | Nicely et al. | |
| 2012/0061913 | A1 * | 3/2012 | Nicely et al. | 273/145 CA |
| 2012/0122545 | A1 * | 5/2012 | Watkins et al. | 463/20 |
| 2012/0202575 | A1 | 8/2012 | Matsuno | |
| 2014/0210644 | A1 * | 7/2014 | Breed | 340/905 |
| 2014/0319769 | A1 * | 10/2014 | MacDonald et al. | 273/142 E |

* cited by examiner

ROULETTE WHEEL WITH SMART COVER

CROSS-REFERENCE TO RELATED APPLICATION

The present application claims the benefit of U.S. Provisional Patent Application Ser. No. 61/754,454, entitled "ROULETTE & COVER APPARATUS," filed on Jan. 18, 2013, which is hereby incorporated by reference in its entirety for all purposes.

BACKGROUND

The outcomes of various games, including casino games, may be decided according to one or more variables. In the game of roulette, a wheel is spun in one direction, and a ball in the opposite direction around a tilted circular track running around the inner circumference of the wheel. The ball eventually loses momentum and falls into one of a number of colored and numbered pockets on the wheel. However, for a time before the ball loses velocity, players may place wagers on where the ball will eventually end up. For example, a player may bet that the ball will land in a pocket for a specific number, color, or whether the number is going to be an odd or an even number. The game administrator (e.g., croupier or dealer) is responsible for stopping the betting before the ball loses velocity so that the players cannot estimate when or where the ball will fall.

SUMMARY

The subject technology provides a system and method for delaying an outcome of a roulette game. In this regard, an example system includes a roulette wheel comprising a plurality of pockets, each pocket for stationary confinement of a ball, a glass cover attached to the roulette wheel, the glass cover configured to switch between a transparent state and an opaque state in response to electrical signals, and game circuitry operably connected to the glass cover, the game circuitry configured to switch the glass cover from the transparent state to the opaque state and back to the transparent state at one or more predetermined events or predetermined periods during play of the roulette game. In this regard, the game circuitry may launch a ball around an inner circumference of the roulette wheel, and to send a first electrical signal to the glass cover while the ball is in motion around the inner circumference to change the glass cover from the transparent state to the opaque state so that the ball cannot be viewed from outside the glass cover. Other aspects include corresponding methods, apparatus, and computer program products.

In another aspect, an example method includes launching a ball around a roulette wheel, the roulette wheel having a glass cover configured to switch between a transparent state and an opaque state in response to one or more electrical signals, and switching the glass cover from the transparent state to the opaque state and back to the transparent state at one or more predetermined events or predetermined periods during play of the roulette game. In this regard the method may comprise sending a first electrical signal to the glass cover while the ball is in motion around the roulette wheel to change the glass cover from the transparent state to the opaque state so that the ball cannot be viewed from outside the glass cover, receiving an indication that the ball has come to rest and is in one of a plurality of pockets on the roulette wheel, and sending a second electrical signal to the glass cover after the indication is received to change the glass cover from the opaque state to the transparent state, so that the ball can be viewed from outside the glass cover. Other aspects include corresponding systems, apparatus, and computer program products for implementation of the computer implemented method.

In a further aspect, the subject technology includes a method for extending a time period for wagers in a game of roulette. For example, the method may include spinning a ball around a roulette wheel, the roulette wheel having a glass cover configured to switch between a transparent state and an opaque state, announcing that wagers may be placed based on an outcome of the spin, a period of time after spinning the ball but before the ball stops spinning, switching the glass cover from the transparent state to the opaque state so that the ball cannot be viewed by players of the game, announcing, while the glass is in the opaque state and after the ball stops spinning, that wagers may no longer be placed, switching the glass cover from the opaque state to the transparent state so that the outcome can be viewed by the players of the game, and accepting wagers before the ball is launched and while the ball is spinning and after the ball has come to rest, wherein the glass is in the opaque state during at least a period when the ball is spinning and after the ball has come to rest. Other aspects include corresponding systems, apparatus, and computer program products for implementation of the method.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides a game apparatus, including a roulette wheel, that is configured to delay viewing an outcome of a game so that wagers may be placed for an extended period of time. In various aspects, the roulette wheel includes a glass cover that is configured to switch between a transparent state and an opaque state. The glass cover may be switched from the transparent state to the opaque state so that a ball spinning around an inner circumference of the roulette table cannot be viewed from the outside of the glass cover by players of the game. Some period after the ball stops spinning and lands within a slot or pocket of the roulette wheel, the glass cover may be switched from the opaque state to the transparent state so that the ball and the outcome of the game can be viewed by the players.

Figure 1A:
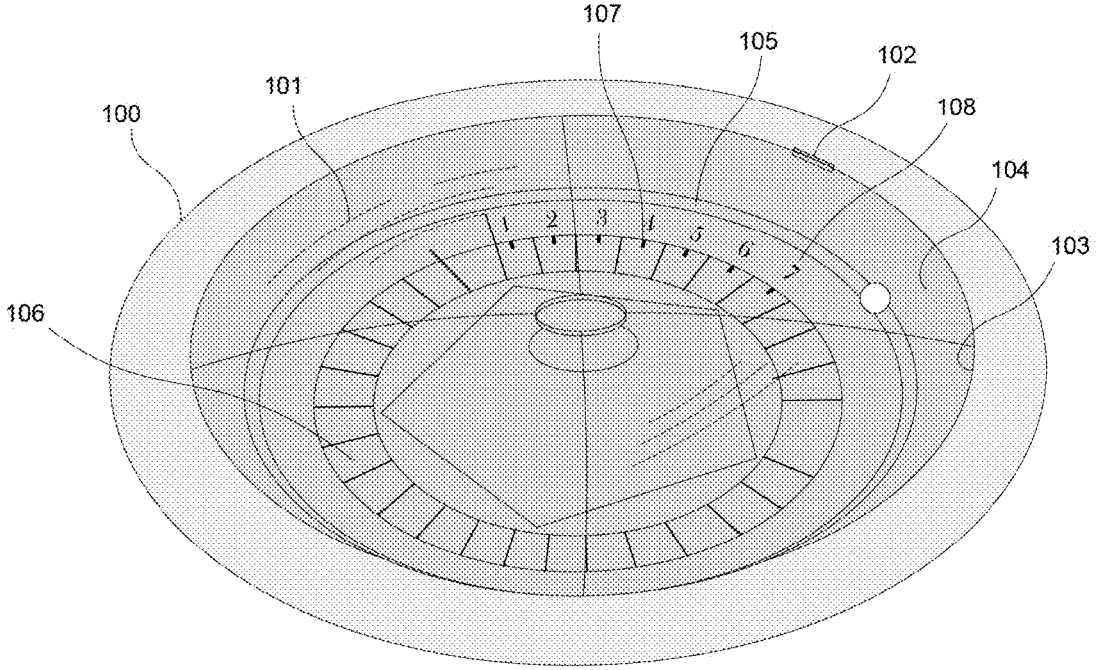
FIG. 1A depicts an example roulette wheel with an example transparent Smart Glass cover positioned above an interior portion of the roulette wheel.
Figure 1B:
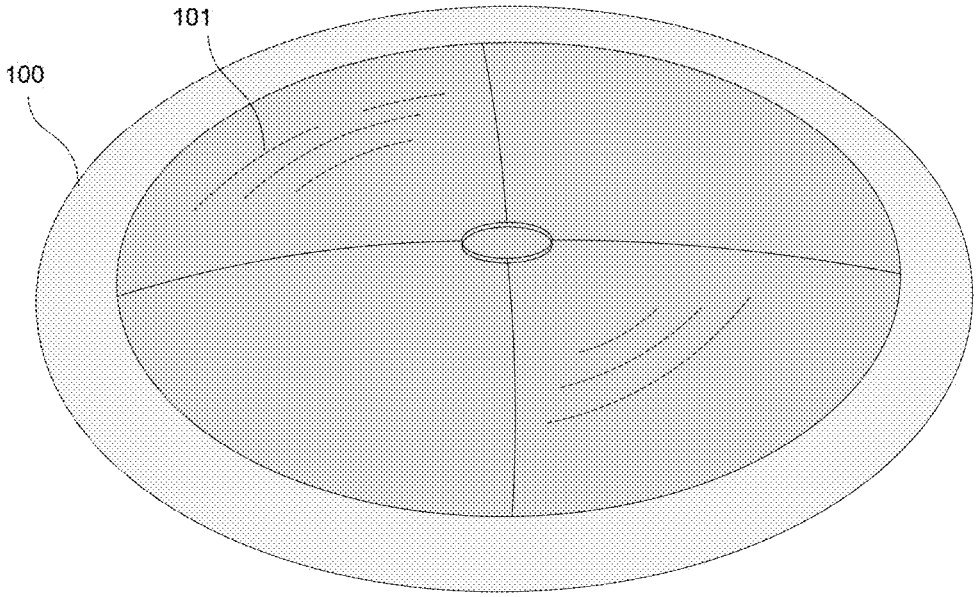
FIG. 1B depicts the example roulette wheel with the example Smart Glass cover changed to an opaque state.

FIGS. 1A and 1B depict an example roulette wheel 100 with an example Smart Glass cover 101 positioned above an interior portion of the roulette wheel, according to one or more aspects of the subject technology. One or more portions of cover 101 are constructed of a material that allows a user to control the amount of light transmission through the cover by application of an electrical signal. Accordingly, the material, or "Smart Glass," of cover 101 may be constructed as or to include one or more electrochromic devices, suspended particle devices, micro-blinds, or liquid crystal devices. When activated, the glass portions of cover 101 change from transparent to opaque or vice versa, providing partial or complete concealment of the interior portion of the roulette wheel when cover 101 is in the opaque state. The default state of the glass may be either the transparent or the opaque state. The type of electrical signal may vary depending on the type of smart glass technology used. For example, the electrical signal may be a predetermined voltage or current. In some implementations the Smart Glass of cover 101 may include one or more glazings that change light transmission properties in response to an environmental signal such as light or temperature.

With regard to FIG. 1A, roulette wheel 100 is depicted with cover 101 in a transparent state. Cover 101 may be attached to roulette wheel by way of a hinge 102 or other mechanism to maintain placement of cover 101 over roulette wheel 100. For example, roulette wheel 100 may be configured with an inner ledge 103 around an interior circumference 104 of roulette wheel 100. Accordingly, cover 101 may sit atop inner ledge 103 with a wall of inner circumference 104, maintaining cover 100 in a stationary position. Cover 101 may be removed from roulette wheel 100 by lifting the cover from ledge 103. In some aspects, hinge 102 may confine motion of cover 100 to an arc pattern when lifted, and allow cover 100 to be left open in a partially lifted position, for example, to remove or spin a ball or to clean roulette wheel 100.

Viewable through cover 101, roulette wheel 100 includes an interior track or groove 105 around interior circumference 104 of the roulette wheel. For reference, a ball is depicted traveling along track 105, spinning around interior circumference 104. Roulette wheel 100 further includes a plurality of pockets 106, each pocket is configured to confine the ball after the ball has completed spinning around the interior track 105. Pockets 106 may be on a separate portion, or "platter," of roulette wheel 100 that spins, for example, in an opposite direction than the ball. Each pocket 106 may be configured with a pocket sensor 107 that is configured to detect when the ball has come to a rest within the pocket. Using pocket sensors 107, a final pocket location in which the ball comes to a rest after being launched around the inner circumference of the roulette wheel may be recorded and privately communicated to an authorized game administrator while the glass cover is in the opaque state.

Cover 101 or other similar cover is placed over at least the face of wheel such that at least the pockets of the roulette wheel are concealed when the cover is opaque. Cover 101 is made of a smart glass or other material that may be manipulated into alternately concealing and then revealing one or more portions of the roulette wheel during the course of a game. In the depicted example, cover 101 is a dome that includes a hole or cutout at a top center location. This hole allows for an ornamental turret, such as a dragon element, to be inserted and displayed through the cover for decorative purposes. It is understood that cover 101 may be flat, cylindrical, or any form configured to conceal portions of the roulette wheel when in the opaque state. Cover 101 may also be constructed without any openings, for example, as a continuous piece of glass (e.g., smart glass) or other material.

FIG. 1B depicts roulette wheel 100 with the cover 101 changed to an opaque state. Concealing the wheel may include activating the glass to become opaque or close to opaque. Activating cover 101 to conceal portions of roulette wheel 100 may be under the control of the game administrator or may be automatically controlled based on various rules. As depicted by the example implementation, once cover 101 is activated the location of the ball within roulette wheel can no longer be viewed from the outside of the glass cover by players of the game. When the ball finally comes to a stop in a final pocket location, wagers may still be taken since the outcome is concealed from the players.

Turning back to FIG. 1A, pocket sensors 107 may detect the final pocket location of the ball and the location and privately communicated to the game administrator. Roulette wheel 100 may also be equipped with one or more sensors configured to track the position, velocity, direction, acceleration, deceleration, and the like, of the roulette ball. Such sensors provide information that can be used to devise rules as to when to conceal and when to reveal the wheel. For example, a casino may designate a certain ball position (e.g., along track 105) or number of rotations of the ball around the roulette wheel at which to activate cover 101 and conceal the ball and other portions of roulette wheel. Likewise, electronics integrated with one or more portions of roulette wheel (e.g., cover 101 and one or more sensors) may further designate a velocity or point in deceleration at which to switch cover 101 between transparent and opaque states (see, e.g., game circuitry 203 of FIG. 2). Such a mechanism for concealing and revealing allows additional time at which to place wagers, as well as possibly heightening excitement upon the reveal.

A typical game involving the gaming apparatus may start similar to traditional roulette games by spinning the wheel and introducing the ball. A major difference, however, is that while the wheel is still spinning, and the ball still moving, the wheel may be concealed by activation of the cover to allow more time for wagers to be placed on the outcome of a game. Once betting is closed, the wheel may be revealed in a manner desired by the casino operating the game (e.g., dealer control or automatic control).

Each pocket 106 may be labeled with a number 108. Unlike traditional roulette wheels, however, the numbers associated with the pockets may be listed in consecutive numerical order. Further, in some embodiments, the slots of the wheel may be further divided into multiple groups, which may each be associated with a symbol designated according to a theme.

For example, a wheel may divide its slots into five groups, and the symbols may represent the elements of wood, fire, water, earth, and gold. Results of such a game may include any possible combination of color, group, and slot. As such results differ from those of a typical roulette wheel, variations on typical roulette betting rules may be devised. In that regard, one may bet based on color, symbol, or type of slot number.

Figure 2:
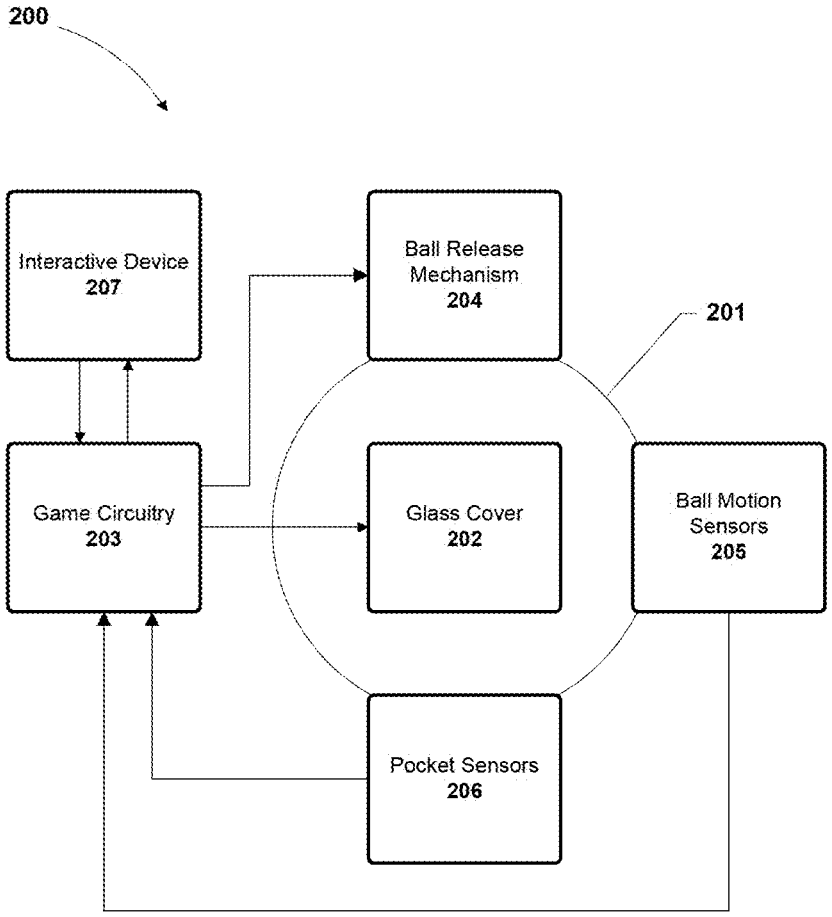
FIG. 2 depicts an example component diagram for delaying an outcome of a roulette game.

FIG. 2 depicts an example component diagram for delaying an outcome of a roulette game, according to one or more aspects of the subject technology. A system 200 includes a roulette wheel 201 with a glass cover 202 configured to switch between a transparent state and an opaque state in response to electrical signals, and game circuitry 203. As described previously, glass cover 202 provides an encasement over the circumference of roulette wheel 201 (including, e.g., a plurality of pockets), concealing the covered area when in the opaque state. System 200 may further include one or more components operably connected to roulette wheel and game circuitry 203, including a ball release mechanism 204, one or more ball motion sensors 205, and a plurality of pocket sensors 206.

As described previously, the roulette wheel includes a plurality of pockets, with each pocket being for stationary confinement of a roulette ball. Each pocket includes a respective one of pocket sensors 206 configured to detect when the ball has come to a rest and is positioned within the pocket, and to communicate that the ball has come to rest and/or an identification of the final pocket location to game circuitry 203. Game circuitry 203 may be configured to publicly communicate that the ball came to a rest while glass cover 202 is in the opaque state based on signals from sensors 205 or 206 without game administrator involvement. In some implementations, game circuitry 203 may privately communicate that the ball came to a rest and/or the final pocket location to an authorized game administrator, for example, while glass cover 202 is in the opaque state. The final pocket location may communicated to, for example, a wired or wireless earpiece, mobile device, or other device where communications may be received without interception by players engaged in the game. In some aspects, communications may be scrambled or encrypted to prevent surreptitious interception.

Game circuitry 203 is operably connected to glass cover 202, and configured to operate ball release mechanism 204 to launch a ball around an inner circumference of roulette wheel 201. The launching of the ball may be triggered manually by the game administrator or automatically by game circuitry 203. Game circuitry 203 is further configured to send a first electrical signal, at a predetermined time or event (e.g., change in velocity, trajectory, or the like), to glass cover 202 while the ball is in motion around the inner circumference to change the glass cover from the transparent state to the opaque state so that the ball cannot be viewed from outside the glass cover. In some aspects, game circuitry 203 may be configured to automatically send the first electrical signal a predetermined time after the ball is launched around the inner circumference of the roulette wheel.

Similarly, game circuitry 203 is configured to send a second electrical signal to change the glass cover from the opaque state to the transparent state so that the ball can be viewed from outside the glass cover. In some implementations, the second electrical signal may be automatically sent a predetermined time after the ball has come to rest in the final pocket location, and/or a predetermined time after the roulette wheel has stopped spinning.

In some implementations, the second electrical signal may be sent in response to a manual interaction with game circuitry 203. For example, game circuitry may include a button or switch that sends the first or second electronic signal when activated (e.g., depressed) by the game administrator. Additionally or in the alternative, game circuitry may include one or more motion sensors configured to detect gestures proximate the outside of roulette wheel 201. For example, game circuitry 203 may be configured to detect a predetermined gesture, and send the first or second electronic signals in response to the gesture. Gestures may include waving a hand over a portion of roulette wheel 201, for example, over glass cover 202.

System 200 may also include an interactive device 207 for providing alerts to the players of the game, and/or the game administrator. Interactive device 207 may be, for example, a touch screen display that also provides visual feedback of game activities. In one or more implementations, interactive device 207 may include one or more buttons for sending the first and second electrical signals. For example, interactive device 207 may be a touchscreen that visually depicts the buttons for sending the electrical signals. Interactive device 207 may include multiple displays, each for a different function. For example, interactive device 207 may provide a public display to players of the roulette game, and a private display to the game administrator. In another example, interactive device 207 may be a button that changes colors depending on the state of system 200.

Interactive device 207, in connection with game circuitry 203, may be configured to display a first alert condition in connection with glass cover 202 changing from the transparent state to the opaque state, and to display a second alert condition in connection with the ball coming to rest at its final pocket position. For example, a portion of interactive device 207 may turn solid red when glass cover 202 changes from the transparent state to the opaque state, and begin to flash red when the ball stops spinning and enters or comes to a rest in the final pocket position. In some aspects, interactive device 207 may be configured to display a third alert condition when roulette wheel 201 becomes completely stationary and the ball is in the final pocket location, and/or the game administrator has indicated that all wagers have been paid. For example, display device may change to solid green to alert the players and the game administrator that new wagers may be placed for a new game, and/or roulette wheel 201 is ready to spin again. In some implementations, game circuitry 203 is configured to not allow a new spin of the ball until the third alert condition is active.

One or more ball motion sensors 205, in connection with game circuitry 203, are configured to track the ball as it moves around roulette wheel 201. For example, sensors 205 may detect a velocity of the ball as it travels around the inner circumference of the roulette wheel, and game circuitry 203 may be configured to send the first electrical signal when the velocity drops below a predetermined threshold velocity. Sensors may detect a rotation of the ball around the inner circumference of the roulette wheel, and game circuitry 203 may be configured to send the first electrical signal when the ball has traveled a predetermined number of times around the inner circumference.

Figure 3:
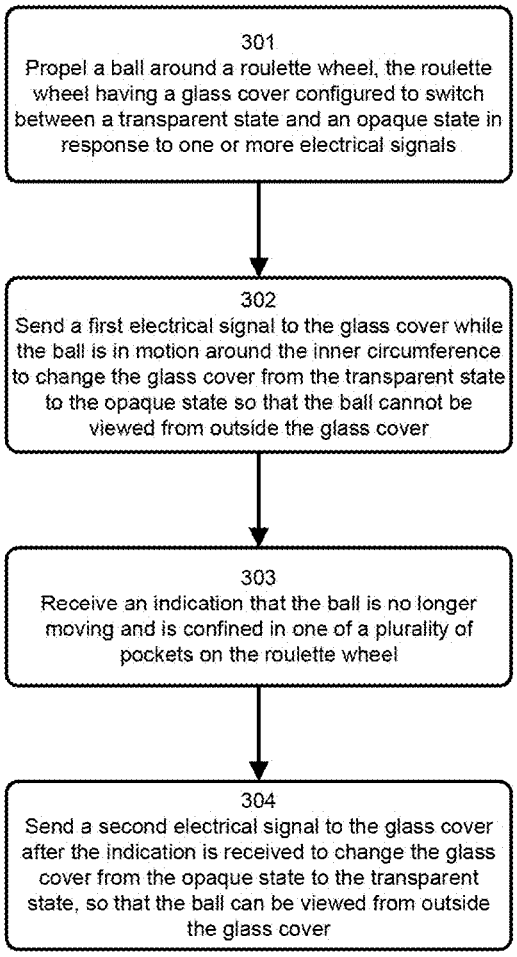
FIG. 3 is a flowchart depicting an example process of delaying an outcome of a roulette game.

FIG. 3 is a flowchart depicting an example process of delaying an outcome of a roulette game, according to one or more aspects of the subject technology. The blocks of FIG. 3 do not need to be performed in the order shown. It is understood that the depicted order is an illustration of one or more example approaches, and are not meant to be limited to the specific order or hierarchy presented. The blocks may be rearranged, and/or two or more of the blocks may be performed simultaneously.

According to one or more implementations, one or more blocks of FIG. 3 may be executed by game circuitry 202. Similarly, a non-transitory machine-readable medium may include machine-executable instructions thereon that, when executed by a computer or machine associated with roulette wheel 201, perform the blocks of FIG. 3. Accordingly, the blocks of FIG. 3 may be performed in association with a roulette wheel having a glass cover that is configured to switch between a transparent state and an opaque state.

In block 301, a ball is launched (e.g., spun) around a roulette wheel. In various aspects, the roulette wheel has a glass cover attached thereto and configured to switch between a transparent state and an opaque state in response to one or more electrical signals.

In block 302, a first electrical signal is sent to the glass cover while the ball is in motion around the inner circumference to change the glass cover from the transparent state to the opaque state so that the ball cannot be viewed from outside the glass cover. As described previously, game circuitry 202 may automatically send the first electrical signal when a velocity of the ball drops below a predetermined threshold velocity, or when the ball has traveled a predetermined number of times around the roulette wheel, or when a predetermined time after the ball is has been launched, or by manual activation of a button by the game administrator.

In block 303, an indication is received, the indication being that the ball is no longer moving and has come to a rest in one of a plurality of pockets on the roulette wheel. The indication may be provided, for example, by the detection of the ball in a pocket of the roulette wheel by a corresponding pocket sensor 205, or by some visual detection by the game administrator. In one or more implementations, the indication may be a private communication sent to the game administrator informing the game administrator that the ball has come to a rest and/or informing the game administrator of the final location of the ball.

In block 304, a second electrical signal is sent to the glass cover after the indication is received to change the glass cover from the opaque state to the transparent state, so that the ball can be viewed from outside the glass cover. In some implementations, the second electrical signal is automatically sent a predetermined period of time after the ball is no longer moving. Accordingly, game circuitry may include a timer that activates after a pocket sensor senses that the ball is in a final pocket location. On an expiration of the timer, game circuitry 202 automatically sends the electrical signal (e.g., applies a current or voltage to glass cover 201).

Figure 4:
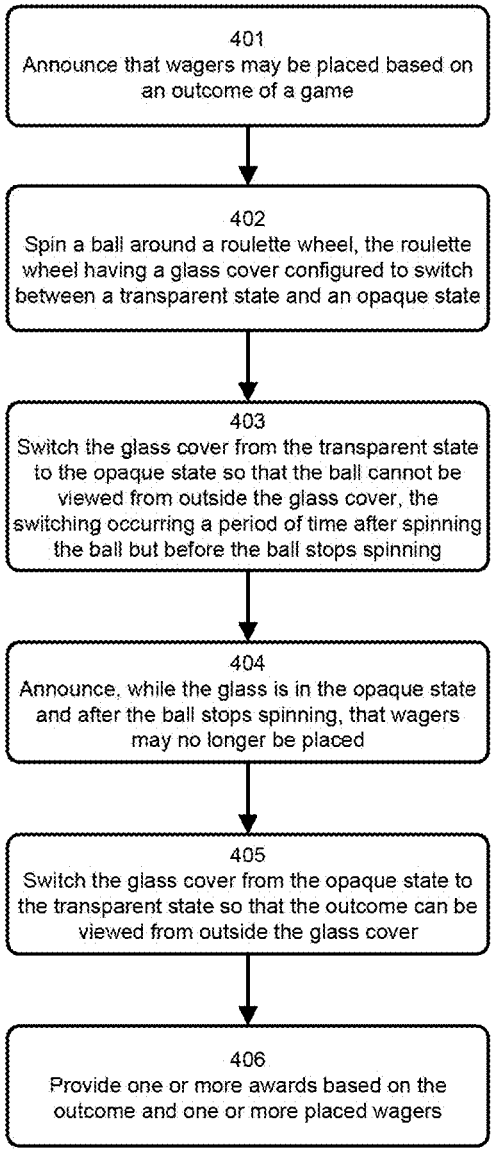
FIG. 4 is a flowchart depicting an example process for extending a time period for wagers in a roulette game.

FIG. 4 is a flowchart depicting an example process for extending a time period for wagers in a roulette game, according to one or more aspects of the subject technology. The blocks of FIG. 4 do not need to be performed in the order shown. It is understood that the depicted order is an illustration of one or more example approaches, and are not meant to be limited to the specific order or hierarchy presented. The blocks may be rearranged, and/or two or more of the blocks may be performed simultaneously.

According to one or more implementations, one or more blocks of FIG. 4 may be executed by game circuitry 202 and/or a game administrator. Similarly, a non-transitory machine-readable medium may include machine-executable instructions thereon that, when executed by a computer or machine associated with roulette wheel 201, perform at least a portion of the functions of FIG. 4. Accordingly, the blocks of FIG. 4 may be performed in association with a roulette wheel having a glass cover that is configured to switch between a transparent state and an opaque state.

At the beginning of a roulette game, in block 401, a game administrator announces that wagers may be placed. Players may be allowed to place wagers before or during the spinning of the ball and after the ball has come to a rest. Accordingly, the game administrator activates (e.g., presses) the spin button to launch the ball around the roulette wheel to begin the game.

In block 402 a ball is spun (e.g., launched) around a roulette wheel. In various aspects, the roulette wheel has a glass cover attached thereto and configured to switch between a transparent state and an opaque state. Accordingly, a game administrator activates (e.g., presses) a spin ball button to automatically launch the ball. The button may be a physical button, or displayed on a touch screen. The button may be configured to glow or be displayed on one of a plurality of colors. For example, the button may be displayed in green, red, or flashing red. In one example, the button must be green to launch the ball around the roulette table.

In block 403, a period of time after spinning the ball but before the ball stops spinning, the glass cover is switched from the transparent state to the opaque state so that the ball cannot be viewed from outside the glass cover. The ball spins around the roulette wheel, and the Smart Glass turns opaque at a predetermined time after launching the ball, or after a predetermined event, for example, after a velocity change or after the ball drops off track 105 but before the ball comes to a rest in a pocket. The spin ball button may turn red after the ball is launched or after the glass turns opaque. The glass remains opaque after the ball has come to a rest. Wagers may continue to be placed at this time, until the game administrator announces no more wagers may be placed.

In block 404, while the glass is in the opaque state and after the ball stops spinning, the game administrator announces that wagers may no longer be placed. After the ball has come to a rest in a pocket, the spin ball button may be shown as flashing red. Once the players have had sufficient time to place their bets, the game administrator announces "no more bets." Additionally, the announcement may be accompanied by a horizontal gesture of the hand over the layout to stop any further wagering, and a bell may be rung. In this example, no wagers are accepted after the game administrator has called no more bets. Accordingly, wagers may be placed before the ball is launched, while the ball is spinning, and after the ball has come to rest.

After the game administrator has announced no more bets, the spin ball button is activated and the Smart Glass turns transparent to expose the outcome of the game (including, e.g., the winning game result). In block 405, the glass cover is activated to turn from the opaque state to the transparent state so that the outcome can be viewed by the players. The game administrator visually confirms the result and announces the winning number. The spin ball button then turns off and remains off until the roulette wheel comes to a complete stop. The spin button may then automatically change to green when the wheel has completely stopped. In one or more implementations, the ball cannot be spun again until the spin ball button has turned green.

In block 406, one or more awards are provided based on the outcome and one or more placed wagers. Accordingly, losing wagers are taken by the house, and the winning players paid according to predetermined rules. For example, winning wagers may be paid at odds in the same fashion as traditional Roulette.

The game administrator may activate the spin ball button to commence a new game. As described previously, game circuitry 202 may be configured to require the game administrator to wait until the wheel comes to rest and the spin button turns green before the spin button may be activated again. The previous blocks may be repeated for subsequent games.

Figure 5:
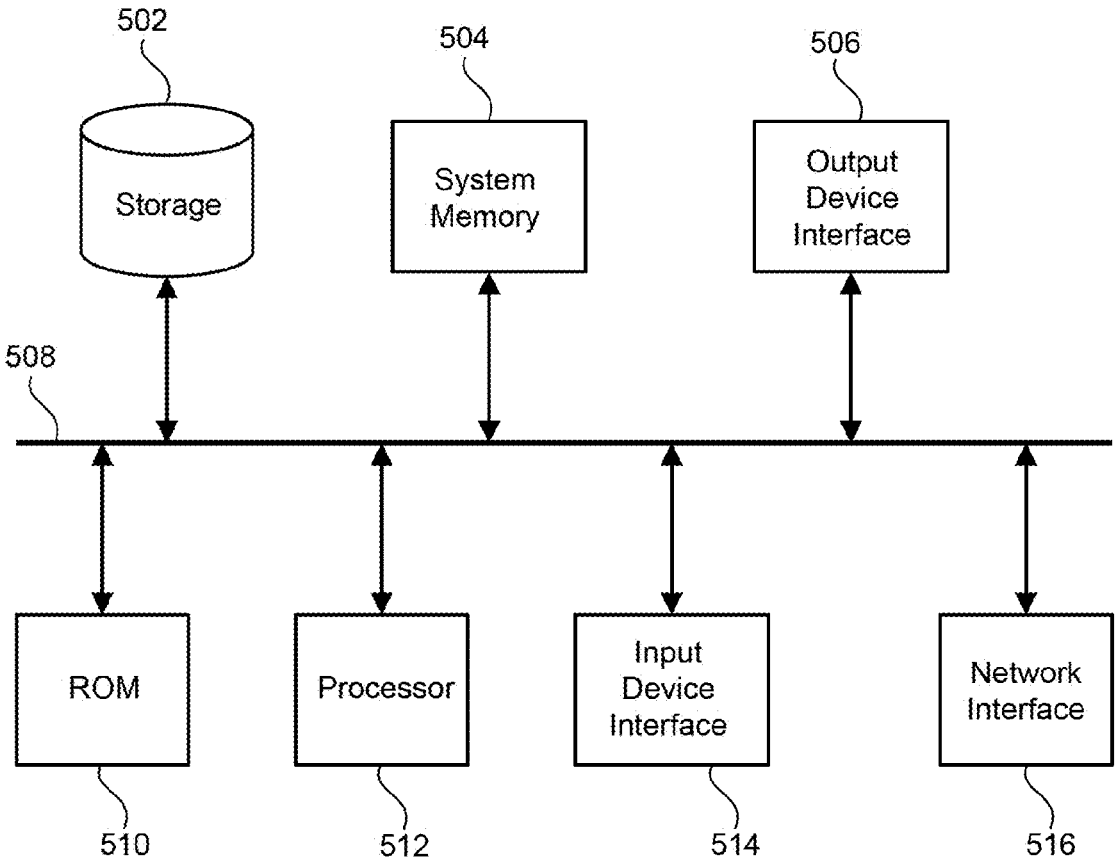
FIG. 5 is a diagram illustrating an example electronic system for use in connection with delaying an outcome of a roulette game, including a processor and other related components.

FIG. 5 is a diagram illustrating an example electronic system 500 for use in connection with delaying an outcome of a roulette game, including a processor and other related components, according to one or more aspects of the subject technology. Electronic system 500 may be a computing device for execution of software associated with the operation of roulette wheel 201, game circuitry 203, or various components described above. In various implementations, electronic system 500 may be representative of a server, computer, phone, PDA, laptop, tablet computer, touch screen or television with one or more processors embedded therein or coupled thereto, or any other sort of electronic device.

Electronic system 500 may include various types of computer readable media and interfaces for various other types of computer readable media. In the depicted example, electronic system 500 includes a bus 508, processing unit(s) 512, a system memory 504, a read-only memory (ROM) 510, a permanent storage device 502, an input device interface 514, an output device interface 506, and a network interface 516. In some implementations, electronic system 500 may include or be integrated with game circuitry 200 for operation of the various components and processes previously described.

Bus 508 collectively represents all system, peripheral, and chipset buses that communicatively connect the numerous internal devices of electronic system 500. For instance, bus 508 communicatively connects processing unit(s) 512 with ROM 510, system memory 504, and permanent storage device 502.

From these various memory units, processing unit(s) 512 retrieves instructions to execute and data to process in order to execute the processes of the subject disclosure. The processing unit(s) can be a single processor or a multi-core processor in different implementations.

ROM 510 stores static data and instructions that are needed by processing unit(s) 512 and other modules of the electronic system. Permanent storage device 502, on the other hand, is a read-and-write memory device. This device is a non-volatile memory unit that stores instructions and data even when electronic system 500 is off. Some implementations of the subject disclosure use a mass-storage device (such as a magnetic or optical disk and its corresponding disk drive) as permanent storage device 502.

Other implementations use a removable storage device (such as a floppy disk, flash drive, and its corresponding disk drive) as permanent storage device 502. Like permanent storage device 502, system memory 504 is a read-and-write memory device. However, unlike storage device 502, system memory 504 is a volatile read-and-write memory, such a random access memory. System memory 504 stores some of the instructions and data that the processor needs at runtime. In some implementations, the processes of the subject disclosure are stored in system memory 504, permanent storage device 502, and/or ROM 510. For example, the various memory units include instructions for facilitating simulating of game play according to various embodiments. From these various memory units, processing unit(s) 512 retrieves instructions to execute and data to process in order to execute the processes of some implementations.

Bus 508 also connects to input and output device interfaces 514 and 506. Input device interface 514 enables the player to communicate information and select commands to the electronic system. Input devices used with input device interface 514 include, for example, alphanumeric keyboards and pointing devices (also called "cursor control devices"). Output device interfaces 506 enables, for example, the display of images generated by the electronic system 500. Output devices used with output device interface 506 include, for example, printers and display devices, such as cathode ray tubes (CRT) or liquid crystal displays (LCD). Some implementations include devices such as a touchscreen that functions as both input and output devices.

Finally, as shown in FIG. 5, bus 508 also couples electronic system 500 to a network (not shown) through a network interface 516. In this manner, the computer can be a part of a network of computers (such as a local area network ("LAN"), a wide area network ("WAN"), or an Intranet, or a network of networks, such as the Internet. Any or all components of electronic system 500 can be used in conjunction with the subject disclosure.

These functions described above can be implemented in digital game circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a player, implementations of the subject matter described in this specification can be implemented on a computer having a display device, e.g., a CRT (cathode ray tube) or LCD (liquid crystal display) monitor, for displaying information to the player and a keyboard and a pointing device, e.g., a mouse or a trackball, by which the player can provide input to the computer. Other kinds of devices can be used to provide for interaction with a player as well; for example, feedback provided to the player can be any form of sensory feedback, e.g., visual feedback, auditory feedback, or tactile feedback; and input from the player can be received in any form, including acoustic, speech, or tactile input. In addition, a computer can interact with a player by sending documents to and receiving documents from a device that is used by the player; for example, by sending web pages to a web browser on a player's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical player interface or a Web browser through which a player can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a player interacting with the client device). Data generated at the client device (e.g., a result of the player interaction) can be received from the client device at the server.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as an "aspect" may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as a "configuration" may refer to one or more configurations and vice versa.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. No claim element is to be construed under the provisions of 35 U.S.C. §112, sixth paragraph, unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A system for delaying an outcome of a roulette game, the system comprising:

a roulette wheel comprising a plurality of pockets, each pocket for stationary confinement of a ball;

a glass cover attached to the roulette wheel, the glass cover configured to switch between a transparent state and an opaque state in response to electrical signals; and game circuitry operably connected to the glass cover, the game circuitry configured to switch the glass cover from the transparent state to the opaque state and back to the transparent state at one or more predetermined events or predetermined periods during play of the roulette game, and to send a first electrical signal to the glass cover while a ball is in motion around an inner circumference of the roulette wheel to change the glass cover from the transparent state to the opaque state so that the ball cannot be viewed from outside the glass cover.

2. The system of claim 1, wherein each pocket includes a pocket sensor configured to detect when the ball has come to rest within the pocket, and wherein the game circuitry is configured to detect, using a respective pocket sensor, a final pocket location in which the ball comes to rest after being launched, and to communicate that the ball has come to rest while the glass cover is in the opaque state.

3. The system of claim 2, wherein the game circuitry is configured to privately communicate the final pocket location to an authorized game administrator while the glass cover is in the opaque state.

4. The system of claim 2, further comprising:

an interactive device operably connected to the game circuitry and configured to display a first alert condition in connection with the glass cover changing from the transparent state to the opaque state, and to display a second alert condition in connection with the ball coming to rest in the final pocket position;

wherein the display of the first alert condition comprises displaying a solid color, and the display of the second alert condition comprises displaying a flashing color.

5. The system of claim 4, further comprising:

a release mechanism, wherein the interactive device is configured as a ball release switch that, when activated, activates a ball release mechanism to launch the ball.

6. The system of claim 1, wherein the game circuitry is configured to send a second electrical signal a predetermined time after the ball has come to rest in the final pocket location, the second electrical signal changing the glass cover from the opaque state to the transparent state so that the ball can be viewed from outside the glass cover.

7. The system of claim 1, further comprising:

a ball motion sensor operably connected to the game circuitry and configured to detect a velocity of the ball as it travels around an inner track of the roulette wheel, wherein the game circuitry is configured to send the first electrical signal when the velocity satisfies a predetermined threshold velocity.

8. The system of claim 1, further comprising:

a ball motion sensor operably connected to the game circuitry and configured to detect a rotation of the ball around the inner circumference of the roulette wheel, the first electrical signal being sent when the ball has traveled a predetermined number of times around the inner circumference.

9. The system of claim 1, wherein the game circuitry is configured to send the first electrical signal a predetermined time after the ball is launched around the inner circumference of the roulette wheel.

10. The system of claim 1, wherein the glass cover comprises a glass cover providing an encasement over at least the plurality of pockets of the roulette wheel, the glass cover completely obscuring the inner circumference and plurality of pockets when in the opaque state.

11. A method for delaying an outcome of a roulette game, comprising:

launching a ball around a roulette wheel, the roulette wheel having a glass cover configured to switch between a transparent state and an opaque state in response to one or more electrical signals;

sending a first electrical signal to the glass cover while the ball is in motion around the roulette wheel to switch switching the glass cover from the transparent state to the opaque state so that the ball cannot be viewed from outside the glass cover and back to the transparent state at one or more predetermined events or predetermined periods during play of the roulette game; and receiving an indication that the ball is no longer moving and has come to rest in one of a plurality of pockets on the roulette wheel; and sending a second electrical signal to the glass cover after the indication is received to change the glass cover from the opaque state to the transparent state, so that the ball can be viewed from outside the glass cover.

12. The method of claim 11, wherein the second electrical signal is sent a predetermined period of time after the ball has come to rest.

13. The method of claim 11, further comprising:

sending the first electrical signal when a velocity of the ball decreases below a threshold velocity.

14. The method of claim 11, further comprising:

sending the first electrical signal when the ball has traveled a predetermined number of times around the roulette wheel.

15. The method of claim 11, further comprising:

sending the first electrical signal a predetermined time after the ball is launched around the roulette wheel.

16. The method of claim 11, further comprising:

displaying a first alert in connection with the glass cover changing to the opaque state; and displaying a second alert on or after the ball is no longer moving and has come to rest.

17. The method of claim 11, further comprising:

communicating a pocket location of the ball when the ball has come to rest and the glass cover is in the opaque state.

* * * * *